US009321469B2

(12) United States Patent
Hann

(10) Patent No.: US 9,321,469 B2
(45) Date of Patent: Apr. 26, 2016

(54) SYSTEM AND METHOD FOR EXPANDED MONITORING AND CONTROL OF RAILROAD WAYSIDE INTERLOCKING SYSTEMS

(71) Applicant: QuEST Rail LLC, Moberly, MO (US)

(72) Inventor: Gregory K. Hann, Odessa, MO (US)

(73) Assignee: QuEST Rail LLC, Moberly, MO (US)

( * ) Notice: Subject to any disclaimer, the term of this patent is extended or adjusted under 35 U.S.C. 154(b) by 245 days.

(21) Appl. No.: 14/213,091

(22) Filed: Mar. 14, 2014

(65) Prior Publication Data

US 2014/0263856 A1 Sep. 18, 2014

Related U.S. Application Data

(60) Provisional application No. 61/789,696, filed on Mar. 15, 2013.

(51) Int. Cl.

| | |
|---|---|
| ***B61L 27/00*** | (2006.01) |
| ***B61L 19/06*** | (2006.01) |
| ***B61L 7/06*** | (2006.01) |
| ***B61L 21/04*** | (2006.01) |

(52) U.S. Cl.

CPC . *B61L 7/06* (2013.01); *B61L 19/06* (2013.01); *B61L 21/04* (2013.01); *B61L 27/0061* (2013.01)

(58) Field of Classification Search

CPC . B61L 27/0005; B61L 27/00; B61L 27/0038; B61L 27/0061; B61L 27/0066; B61L 27/0072; B61L 27/0077; B61L 27/0083; B61L 27/0094; B61L 21/04; B61L 23/16; B61L 3/00; B61L 19/00; B61L 19/02; B61L 19/06; B61L 19/065

USPC ..... 701/19; 246/131, 162, 3

See application file for complete search history.

(56) References Cited

U.S. PATENT DOCUMENTS

| | | | |
|---|---|---|---|
| 4,596,029 | A | 6/1986 | Manueco Santurtun et al. |
| 4,601,051 | A | 7/1986 | Santurtun et al. |
| 4,654,770 | A | 3/1987 | Santurtun et al. |

(Continued)

OTHER PUBLICATIONS

Wayside Signaling Systems, MicroLok II: TCP/IP Connectivity and Network Capabilities, www.ansaldo-sts.com, RSE-1A11, Rev. Mar. 2009, p. 1 and 2.

(Continued)

*Primary Examiner* — Mark Le

(74) *Attorney, Agent, or Firm* — Polster Lieder

(57) ABSTRACT

A system and method provides for expanded monitoring and control of a railroad wayside interlocking system that monitors a plurality of track side and train systems and controls a plurality of train and track control devices with a primary control panel system communicating with the interlocking system over a first communication interface and with a remote control panel over a second communication interface, receiving interlocking status messages for visually displaying a current status state of the monitored systems, replicating the received interlocking status messages, determining a current status state for the control devices, communicating replicated interlocking status messages or the determined current status state over the second communication interface to one or more remote control panel systems, and receiving requests from the one or more remote control panel systems, which are then transmitted to the wayside interlocking system by the primary control panel system.

27 Claims, 8 Drawing Sheets

(56) References Cited

U.S. PATENT DOCUMENTS

| | | | | |
|---|---|---|---|---|
| 5,050,823 | A * | 9/1991 | Parker | B61L 7/06 246/219 |
| 5,533,695 | A | 7/1996 | Heggestad et al. | |
| 5,815,823 | A * | 9/1998 | Engle | B60L 15/38 246/187 C |
| 5,823,481 | A * | 10/1998 | Gottschlich | B61L 23/16 246/28 R |
| 5,950,966 | A * | 9/1999 | Hungate | B61L 3/125 246/167 R |
| 6,032,905 | A * | 3/2000 | Haynie | B61L 27/0038 246/167 R |
| 6,034,944 | A * | 3/2000 | Seki | H04Q 11/0478 370/224 |
| 6,122,571 | A * | 9/2000 | Gerstner | A63G 1/10 104/53 |
| 6,308,117 | B1 * | 10/2001 | Ryland | B61L 19/06 246/131 |
| 6,392,553 | B1 | 5/2002 | Mollet et al. | |
| 6,400,281 | B1 | 6/2002 | Darby, Jr. et al. | |
| 7,148,581 | B2 | 12/2006 | Hershey et al. | |
| 7,364,123 | B2 | 4/2008 | Welles, II et al. | |
| 7,823,841 | B2 | 11/2010 | Anderson et al. | |
| 8,032,078 | B1 | 10/2011 | Donich et al. | |
| 2010/0258682 | A1 * | 10/2010 | Fries | B61L 3/121 246/1 C |
| 2011/0238242 | A1 * | 9/2011 | Nichter | B61L 27/0005 701/19 |
| 2012/0325980 | A1 * | 12/2012 | Noffsinger | H04L 12/10 246/169 R |

OTHER PUBLICATIONS

Engineering Specification Signals, Construction Specification, Railcorp, SPG 1230, Design of Microlok II Interlocking, Version 1.6, Issued Nov. 2012.

Engineering Specification Signals, Construction Specification, Railcorp, SPG 1230, Design of Microlok II Interlocking, Version 1.5, Issued Jun. 2011.

TDX Track Driver EXtra Features, Version 2.04, 2002-2007, Kevin Hassett, (14 pages).

TDX—Track Driver eXtra, Local Control Panel Application, Train Track Computer Systems, Inc., Jul. 2003, (pp. 1-5).

GE Transportation, Vital Logic Controller VHLC, A Leader in Interlocking Control doc20032-C, getransporation.com, publication unknown, (2 pages).

Micro-Aide VDL Ansaldo Microlok II Data Logger User Manual, Revised Sep. 24, 2011, Micro-Aide Corporation.

Union Switch & Signal Inc., Microlok II Network Protocol and Networking Hardware, SM 6800K, Original, Mar. 2004.

* cited by examiner

SYSTEM AND METHOD FOR EXPANDED MONITORING AND CONTROL OF RAILROAD WAYSIDE INTERLOCKING SYSTEMS

CROSS-REFERENCE TO RELATED APPLICATIONS

This application claims the benefit of U.S. Provisional Application No. 61/789,696, filed on Mar. 15, 2013, the disclosure of which is incorporated herein by reference.

FIELD

The present disclosure relates to railway systems and, more specifically, to a railroad wayside interlocking system.

BACKGROUND

The statements in this section merely provide background information related to the present disclosure and may not constitute prior art.

A railway management system often includes a local control panel (LCP) that is typically co-located in a wayside equipment house with a microprocessor or relay-based interlocking system for the purpose of field-testing, maintenance, and emergency control (when communications to the central control office has failed). An LCP is a non-vital device that can request a vital interlocking to change its state (e.g. to move a track switch or clear a signal), but the change will only be permitted if the vital interlocking determines it is safe to do so. LCPs have switches (pushbutton or toggle) for entering controls and LEDs (or incandescent lamps) for indication of device status. For example, a pushbutton is pressed to request a track switch to move, and its position is indicated (normal or reverse) via LEDs. The design of an LCP varies based on the type of interlocking control system (microprocessor or relay) and the capabilities of the interlocking controller. Common implementations of an LCP can include panel-mounted switches and lights wired to interposing non-vital relays that interface to the interlocking relay circuits; panel-mounted switches and lights wired to discrete non-vital I/O of the interlocking controller; panel-mounted switches and lights wired to or integrated with a microcontroller that interfaces to the interlocking controller through serial communications; and a laptop computer or rack-mounted touch-screen panel that provides a Graphical User Interface (GUI) and interfaces to the interlocking controller through serial communications. LCPs can be generic for use with any location or customized for a specific location. Typically, a Custom Local Control Panel (CLCP) will have a site-specific track layout and nomenclature. The track layout is usually etched or painted on an aluminum panel. Holes are punched in the panel to install the switches and lights. The switches and lights are then wired to the interlocking or an LCP controller as described above.

However, current CLCPs are inflexible as they do not allow the railway operator to easily expand the displaying and user input request control throughout the railway facility and control down to the local level where a local operator or maintenance personnel can benefit from the access to the status display or for inputting a request.

SUMMARY

The inventor hereof has succeeded at designing a system capable of providing an expansion to a wayside interlocking system for additional locations and user points of contact without modifying or expanding the interlocking system itself or otherwise complicating the design of the interlocking system. The described system and method herein provides a railway operator to expand the monitoring displays and user operability of one or more interlocking systems at lower cost, lower complexity and without customization by the supplier of the interlocking system thereby providing the railway operator considerable expanded and enhanced maintenance and logistics operations of a rail yard or railroad operations.

The present system solves the prior problems and limitations by providing primary and remote panels that support "duplicate panel" functionality without having to redesign or customize the interlocking system itself. The remote panels can be identical to the primary panel and can be located in each remote equipment house or even at the control device itself as a convenience for performing field maintenance and testing. The disclosed system communicates among the primary and remotes over a dedicated or shared network and only the primary panel communicates with the interlocking system thereby providing a transparent and cost-effective expansion solution and providing the railway operator the ability to customize a localized interlocking presence throughout their rail facility.

According to one aspect, a system provides for expanded monitoring and control of a railroad wayside interlocking system that monitors a plurality of track side and train systems and controls a plurality of train and track control devices. The primary control panel system typically has a memory, a processor, a user interface with a display and a user input device, computer executed instructions stored in the memory, a first communication interface and a second communication interface. The first communication interface is coupled to the interlocking system and receives a plurality of interlocking status messages. The primary control panel can also utilize the first communication interface for communicating requests received by the primary control panel system to the interlocking system. The display is responsive to the received interlocking status messages for visually displaying a current status state of the monitored systems. The primary control panel system replicates and otherwise manages the received interlocking status messages, determines a current status state for the control or other devices and communicates the received interlocking status messages or the determined current status state over the second communication interface to one or more remote control panel systems. The remote control panel systems also typically have a memory, a processor, a user interface including a display and a user input device, computer executed instructions stored in the memory and accessible and operable by the processor, and a communication interface communicating with the second communication interface of the primary control panel system. This communication interface of the remote control panel receives the replicated interlocking status messages or the determined current status state and displays at the remote control panel system the current status state of the monitored systems. The user input device of the remote control panel system receives an input request from a user for a change in the state of one or more of the control devices and the remote control panel system transmits a remote request for the change of state of the control device over the communication interface to the second communication interface of the primary control panel system responsive to the receiving of the input request from the user.

In some aspects, the primary control panel system receives the request for the change of state of the control device either from the user input device of the primary control panel or as transmitted from the one or more remote control panels. The primary control panel stores this received request and transmits an interlocking change of control request over the first communication interface to the interlocking system.

According to another aspect, a method provides for expanding the monitoring and controlling of a railroad wayside interlocking system. The method includes functions at a primary control panel system that is coupled to the interlocking system of receiving a plurality of interlocking status messages from the communicatively coupled interlocking system over the first communication interface and displaying a determined current status of one of the monitored systems on the display of the primary control panel system responsive to the received interlocking status messages. The method also includes replicating of the received interlocking status messages and communicating the replicated interlocking status messages or a determined current status state based thereon over the second communication interface. The method includes receiving a request for the change of state of the control device and transmitting an interlocking change of control request over the first communication interface to the interlocking system responsive to the received request for the change of state of the control device. The method also includes functions at one or more remote control panels communicatively coupled to the primary panel control system of receiving the communicated replicated interlocking status messages or the determined current status state and displaying on the display of the remote control panel system the current status state of the monitored systems responsive to the received replicated interlocking status messages and receiving an input request from a user for a change in the state of one or more of the control devices. This method can also include transmitting a message to the primary control panel responsive to the received input request.

Further aspects of the present disclosed system and method will be in part apparent and in part pointed out below. It should be understood that various aspects of the disclosure may be implemented individually or in combination with one another. It should also be understood that the detailed description and drawings, while indicating certain exemplary embodiments, are intended for purposes of illustration only and should not be construed as limiting the scope of the disclosure.

BRIEF DESCRIPTION OF THE DRAWINGS

It should be understood that throughout the drawings, corresponding reference numerals indicate like or corresponding parts and features.

DETAILED DESCRIPTION

Figure 1:
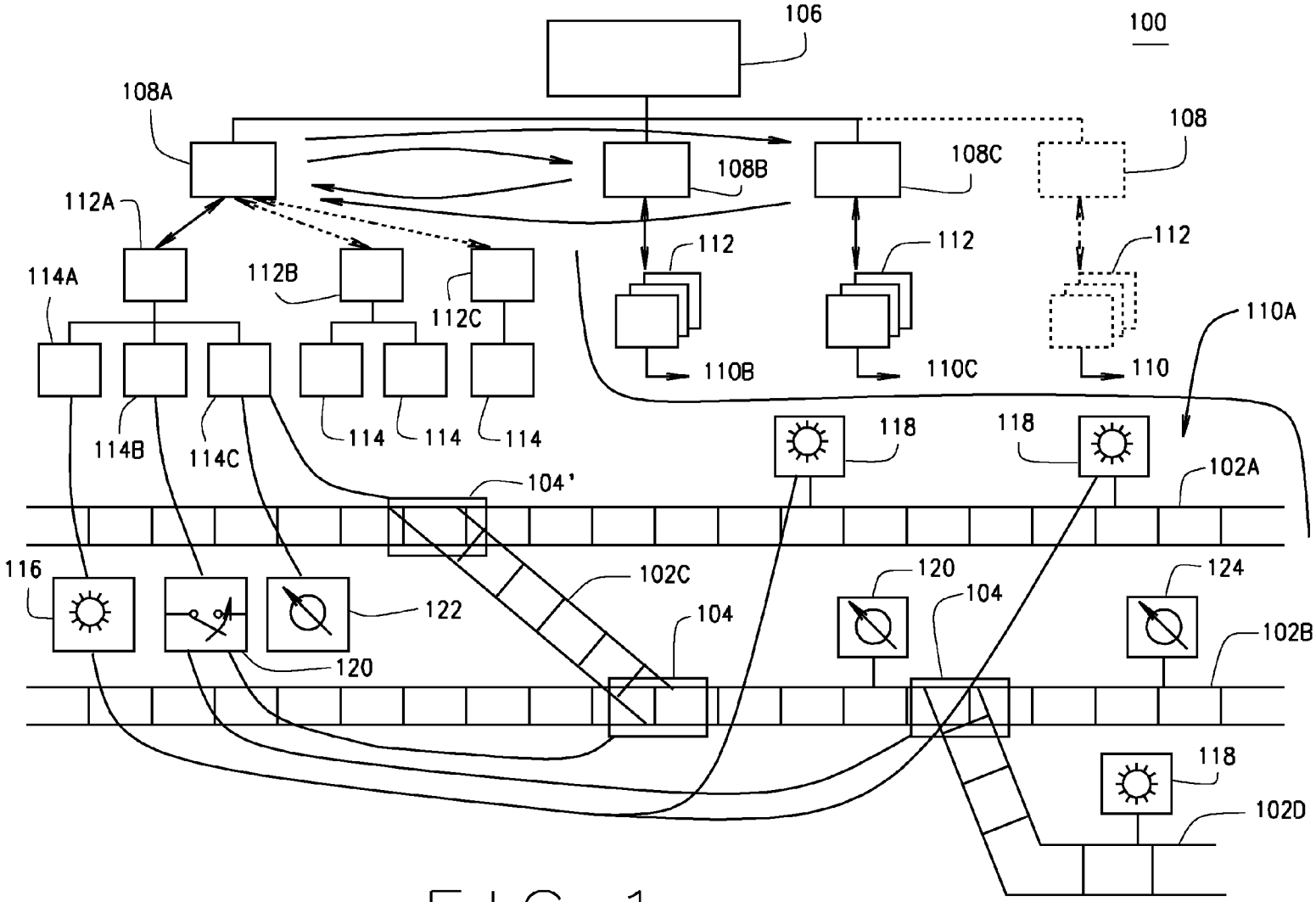
FIG. 1 is a schematic diagram of a railroad facility having a plurality of interlocking systems and expanded monitoring and control according to one exemplary embodiment.

The following description is merely exemplary in nature and is not intended to limit the present disclosure or the disclosure's applications or uses.

While specific exemplary examples, environments and embodiments are discussed herein, one of skill in the art should be understood that this is done for illustration purposes only. A person skilled in this art will recognize that other components and configurations can be used without parting from the spirit and scope of this disclosure. In fact, after reading the following description, it will become apparent to a person skilled in the relevant art how to implement numerous disclosed and supported embodiments as in alternative examples, environments and embodiments.

In one exemplary embodiment, a system provides for expanded monitoring and control of a railroad wayside interlocking system that monitors a plurality of track side and train systems and controls a plurality of train and track control devices. A primary control panel system typically has a memory, a processor, a user interface including a display and a user input device, computer executed instructions stored in the memory and accessible and operable by the processor, a first communication interface and a second communication interface. The first communication interface is coupled to the interlocking system and receives a plurality of interlocking status messages. The primary control panel can also utilize the first communication interface for communicating requests received by the primary control panel system to the interlocking system.

The user input device can be any suitable device for receiving an input from a user such as a push button, a toggle switch, a key, and a touch screen icon, by way of example. The display is responsive to the received interlocking status messages for visually displaying a current status state of the monitored systems. This can include, by way of example, a display of the user interface via LED lights indicative of the determined current status state of the monitored systems such as on a fixed or etched panel illustrating all or a portion of the track side systems including a layout of the railroad track and all or a portion of the monitored track side and train systems and the controlled train and track control devices. For example, this can include a predefined permanent illustration on a faceplate associated with the primary control system and wherein the display includes a light indicator for each monitored device and/or control device. The primary display can also be a computer display screen illustrating all or a portion of the track side systems including a layout of the railroad track and all or a portion of the monitored track side and train systems and the controlled train and track control devices.

The primary control panel system replicates and otherwise manages the received interlocking status messages, determines a current status state for the control or other devices and communicates the received interlocking status messages or the determined current status state over the second communication interface to one or more remote control panel systems.

The remote control panel systems also typically have a memory, a processor, a user interface including a display and a user input device, computer executed instructions stored in the memory and accessible and operable by the processor, and a communication interface communicating with the second communication interface of the primary control panel system. By way of example, the remote control panel system can be a laptop computer, a localized self-contained computer, a mobile telephone, a tablet computer or a customized panel integrated with or located at a control device.

This user input device can be any suitable device for receiving an input from a user such as a push button, a toggle switch, a key, and a touch screen icon, by way of example. The remote control panel system can include an illustrated display that is a duplication of the entire illustrated display of the primary control panel system or can be only a portion of the illustrated display of the primary control panel system. The remote display can be a predefined permanent illustration on a faceplate associated with all or a portion of the illustrated track side systems as displayed by the primary control panel or a duplication thereof of all or the portion.

The first communication interface is one that is typically compatible with the protocol and connections for interworking with the interlocking system to which the present system is to be utilized. The second communication interface of the primary control panel system can be a wired, optical or wireless interface for coupling to a suitable communication network on a point to point basis or on a shared basis with the communication interface(s) of the remote control panel systems. In some embodiments, the first communication interface is coupled to a first communication network and the second communication interface is a separate interface communicating over a separate second communication network. In some embodiments, the first communication interface communicates using a serial communications protocol and wherein the second communication interface communicates using a different communications protocol.

This communication interface of the remote control panel receives the replicated interlocking status messages or the determined current status state and displays at the remote control panel system the current status state of the monitored systems. The user input device of the remote control panel system receives an input request from a user for a change in the state of one or more of the control devices and the remote control panel system transmits a remote request for the change of state of the control device over the communication interface to the second communication interface of the primary control panel system responsive to the receiving of the input request from the user whether via the primary control or the remote.

The remote control panel systems can be a computer system customized by the computer executable instructions and wherein the user input device is an input device of the computer system. For example, this can include a laptop computer, a localized self-contained computer, a mobile telephone, and a tablet computer, by way of example.

In some embodiments, the primary control panel system receives the request for the change of state of the control device either from the user input device of the primary control panel or as transmitted from the one or more remote control panels. The primary control panel stores this received request and transmits an interlocking change of control request over the first communication interface to the interlocking system.

In some embodiments, the primary control panel system receives the remote request from the change of state of the control device from the remote control panel and then transmits the interlocking change of control request over the first communication interface to the interlocking system responsive to the received remote request from the remote or the user interface of the primary system. In other embodiments, the user interface control of the primary control panel system receives an input request from the user for a change in the state of one or more of the control devices. In such embodiments, the primary control panel system transmits the interlocking change of control request over the first communication interface to the interlocking system responsive to the received remote request from the remote.

As noted above, there can be one or more remote control panel systems as described above each of which has a communication interface communicatively coupled to the second communication interface of the primary control panel system. In these cases, the replication of the current status of the control or monitored devices by the primary control panel system is communicated or at least the received interlocking status messages or their determined current status state to each of the remote control panel systems. The primary control panel system can manage the replication of the received interlocking status messages by mapping the received status message to an associated status message state of the remote control panel system.

This primary control panel system communicates to and from the remote control panel system transparently to the communication with the interlocking system so that the only communications and interactions or interfacing with the interlocking system is by the primary control panel. The primary control panel system manages the various remotes, as to their displays, the allocation of the replicated current status of the devices and the receipt and transmittal of any requests by any of the primary or remote user input devices and users thereof for a change of a state. In some embodiments, this can be performed by the primary control panel system uniquely identifying each of the remote control panels and managing each such as by uniquely identifying the request for a change of state of a control device from each remote control panel system. As described herein, this can be mapping of each system or any other suitable method of remote system management and control. Further, as will be addressed below, the mapping and transmission of status messages to the remote by the primary control panel system can be to all of the control devices of the primary panel, or it can be a subset such as by a sub-geographic coverage area or by type of control device.

In some embodiments, the primary control panel system transmits to the interlocking system over the first communication interface the unique identification of the remote control panel system from which the request for change of state was received. In this manner, the interlocking system, while communicating only with the primary control panel system can log or otherwise identify the remote panel originating the request for a change of state.

The primary control panel system can transmit the request for change of state as received from one of the remote control panel systems to the other coupled local control panel systems as a pending request indication associated with the primary control panel system and the coupled remote control panel systems. In this manner, each remote control panel managed by the primary control panel can be notified of the pending request for a change of state. The primary control panel system can also map the received request for a change of state to a request of a change of state to the interlocking system.

In another embodiment, a method provides for expanding the monitoring and controlling of a railroad wayside interlocking system. The method includes functions at a primary control panel system that is coupled to the interlocking system including receiving a plurality of interlocking status messages from the communicatively coupled interlocking system over the first communication interface and displaying a determined current status of one of the monitored systems on the display of the primary control panel system responsive to the received interlocking status messages. The method also includes replicating of the received interlocking status messages and communicating the replicated interlocking status messages or a determined current status state based thereon over the second communication interface.

The method includes receiving a request for the change of state of the control device and transmitting an interlocking change of control request over the first communication interface to the interlocking system responsive to the received request for the change of state of the control device. The method also includes functions at one or more remote control panels communicatively coupled to the primary control panel system of receiving the communicated replicated interlocking status messages or the determined current status state and displaying on the display of the remote control panel system the current status state of the monitored systems responsive to the received replicated interlocking status messages and receiving an input request from a user for a change in the state of one or more of the control devices. This method can also include transmitting a message to the primary control panel responsive to the received input request.

In some embodiments, at the remote control panel system, transmitting over the communication interface to the primary control panel system a remote request for the change of state of the control device is responsive to the received user input, wherein receiving at the primary control panel system the request for the change of state of the control device is the received request for the change of state over the second communication interface from the remote control panel system and wherein transmitting the interlocking change of control request is responsive to the request received from the remote control panel system.

This can include steps at the primary control panel system for receiving an input request from a user of the primary control panel user input device for changing a state of one of the control devices, wherein receiving at the primary control panel system the request for the change of state of the control device is the received request for the change of state from the user input request of the user of the primary control panel user input device and wherein transmitting the interlocking change of control request is responsive to the request received therefrom.

The methods for the primary and remote systems can also be as described above with regard to their functionality with the system. This can include, one or more of the following alone or in combination: a) uniquely identifying each of the coupled remote control panel systems; b) uniquely identifying each request for a change of state of a control device as being associated with the uniquely identified remote control panel system from which the request was received; c) transmitting to the interlocking system the unique identification of the remote control panel system from which the request for change of state was received; d) communicating among the primary and one or more remote control panel systems that is transparent to the communicating with the interlocking system; e) mapping the received status message to an associated status message state of the remote control panel system; f) mapping the received request for a change of state to a request of a change of state to the interlocking system; g) illustrating all or a portion of the track side systems including a layout of the railroad track and all or a portion of the monitored track side and train systems and the controlled train and track control devices; and h) displaying by the primary control system and/or the remote systems a predefined permanent illustration on a faceplate associated with the primary control system and wherein the display includes a light indicator for each monitored device and/or control device.

Referring now to FIG. 1, is a schematic diagram of a railroad facility having a plurality of interlocking systems and expanded monitoring and control according to one exemplary embodiment. In a typical rail yard or railroad operation 100 there are typically numerous rail road tracks 102 (shown as 102A-D in FIG. 1 by way of example) having numerous switches 104. The switches 104 connect and discount a first rail road track 102A with a second railroad track 102B which is often by way of a connecting rail road track 102C. The switches 102 can be hand operated but in most cases today they are remotely monitored and controlled. As shown, a central control system 106 for a railroad system 100 can have an interlocking system 108 interconnected or directly connected to the central control 106. As shown in FIG. 1, a the first interlocking system 108A monitors and controls a first area of track 110A which includes the illustrated tracks 102 A-D and switches 104. FIG. 1 illustrates a second interlocking system 108B that controls a second track area 110B which is not illustrated in detail in FIG. 1, but can be similar to area 110A and similarly a third interlocking system 108C can monitor and control a third track area 110C that is also not illustrated. The interlocking systems 108 and the associated monitored and controlled areas 110 can vary in quantity and complexity in operation of the railroad system 100. To aid in the maintenance and localized maintenance of each of these areas 110, each interlocking controller 108 can include one or more primary control panel systems 112 (shown as 112A, 112B and 112C coupled to interlocking controller 108A, and otherwise indicated simply as 112 being associated with each interlocking controller 108B, 108C, and 108).

Each primary control panel system 112 can include one or more remote control panels 114 shown as 114A, 114B and 114C as being associated with primary control panel system 112A of interlocking controller 108A by way of example. Each primary control panel system 112 or remote control panel can monitor and control all of associated track area 110 or a portion thereof such as being arranged for special functions that are a subset of functions of the central control 102 or the primary control panel system 112. Each of the primary control panel system 114 and its associated one or more remote control panels 114 can physically located in one or more physical locations throughout its monitored and controlled area 102A. Each primary control panel system 114 and associated one or more remote control panels 114 can be localized as to their displayed monitored and controlled systems or can include the entire system of area $A_A$.

These monitored and control systems can include any suitable control device such as a wayside light subsystem 116 monitoring and controlling one or more lights 118, one of the switches 120 that are communicatively coupled to one or more of the switches 104, a switch control subsystem 120 coupled to one or more switches 104, a sensor control and monitoring subsystem 122 communicatively coupled to one or more wayside sensors 124 such as a motion or temperature sensor, or another third party system. As understood by one of skill in the art, the remote systems 114 can be placed at any location or can be mobile within the monitored and controlled area 110 so that a local operating personnel can review or view the current status and can also input a request for a change of status that is then sent back to the primary control panel system 112 for processing and further transmission to the interlocking system 108 and possibly on to the other interlocking systems 108 for coordination directly or via central control 102.

Figure 2:
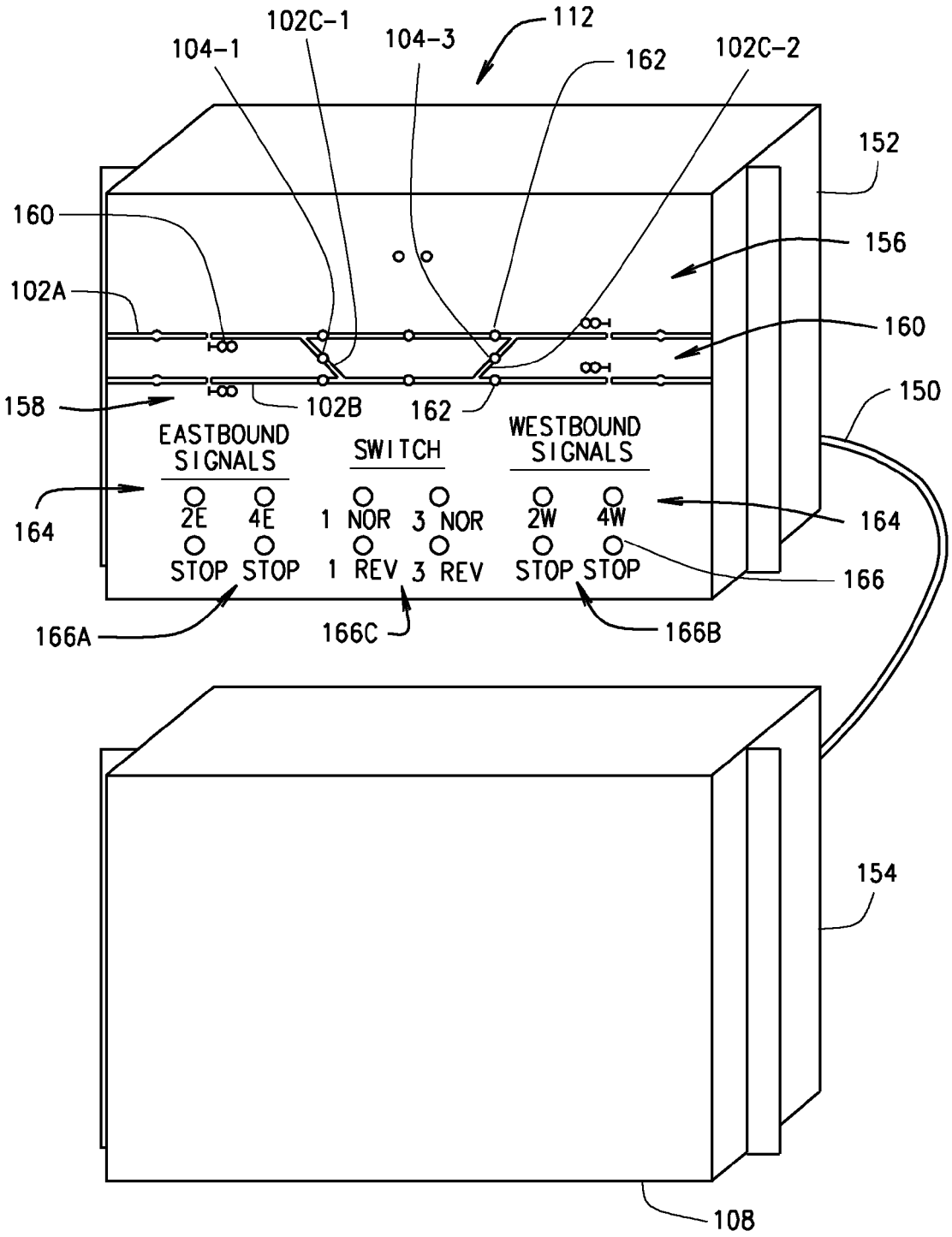
FIG. 2 is an illustration of a primary control panel system coupled via a serial interface with an interlocking controller, each of which are rack mountable physical embodiments according to one exemplary implementation.

FIG. 2 is an example of a primary control panel system 112 coupled via a wired serial communication link to an interlocking controller 108, each of which are rack mountable physical exemplary implementations. As shown, the interlocking controller 108 has a body 154 for mounting but could be of other design. The primary control panel system 112 has a rack mountable body 152 with a front surface panel or user interface 156 that can include a display 158. The display 158 can include a graphical representation or illustration such as a display faceplate/board layout 160 such as the railroad yard area 110 covered or monitored and/or controlled by that particular primary control panel system 112. As shown in this example, the front surface panel 156 includes the display 158 with the display layout 160 graphically depicting two parallel railroad tracks 102A and 102B, with connecting tracks 102C-1 and 102-2, each with a switch 104-1 and 104-3, respectively. Track 102A includes indicators for 1T, and for track 2E and 2W, and track 102B indicators 2T and 4E and 4W. These can be status indicators 160 (such as LED other lights or visual indicators) as described above and can include text indicia describing or naming each or identifying a locations or components within the area 110 as shown in FIG. 2. The status indicators 162 can be indicative of a status of any monitored system such as a light 118, a switch 104 or a sensor 120, with those shown in FIG. 2 as only being one exemplary embodiment.

Also included on the front surface panel or user interface 156 can be a control input interface 164 that includes one or more user inputs 166. As shown, these user inputs 166 can include push buttons, toggle switches or other user input devices and can be arranged for user convenience. As shown, a first set of user inputs 166A is associated with East Bound Signals (such as lights 118) that includes indicators for east bound signals 2E and 2W and a "stop" for each. A second set of user inputs 166B is associated with West Bound Signals (such as lights 118) that includes indicators for west bound signals 2W and 4W and stops for each. A third set of user inputs 166C is associated with control of track switches 104 shown in this example as 1 NOR, 3 NOR, 1 REV and 3 REV. The display layout 160 with status indicators 162 provide a visual depiction of the current status of the monitored devices while user inputs 166 of a control input 166 provides a user positioned at the primary control panel system 112 (or a similarly configured remote control panel system 114) to input a request for a change of status or state of a signal (such as light 118) or a switch 104. This is illustrated in the text description in FIG. 2 of display 158. It should be understood to those skilled in the art that one or more components or features of the primary control panel system 112 and remote control panel system 114 such as the display 158, the graphical depictions 160, the status indicators 162 and the user inputs 166 can be implemented in a computer implemented environment using a computer display and computer inputs and such implementation is considered to be within the scope of the present disclosure. While FIG. 2 illustrates two separate rack mountable bodies 152, 154, it should be understood that this is just one exemplary embodiment and other embodiments can include different packaging arrangements of the functional systems described herein. Further, in some embodiments, since there can be a plurality of remote control panel systems 114 associated with each primary control panel system 112, the user inputs 166, the display 158 and other indicators in each remote control panel system 114 can be for an area or subset or portion (including geographic as well as operational or functional subset) of that of the primary control panel system 112 from which the remote control panel system 114 is associated.

Figure 3:
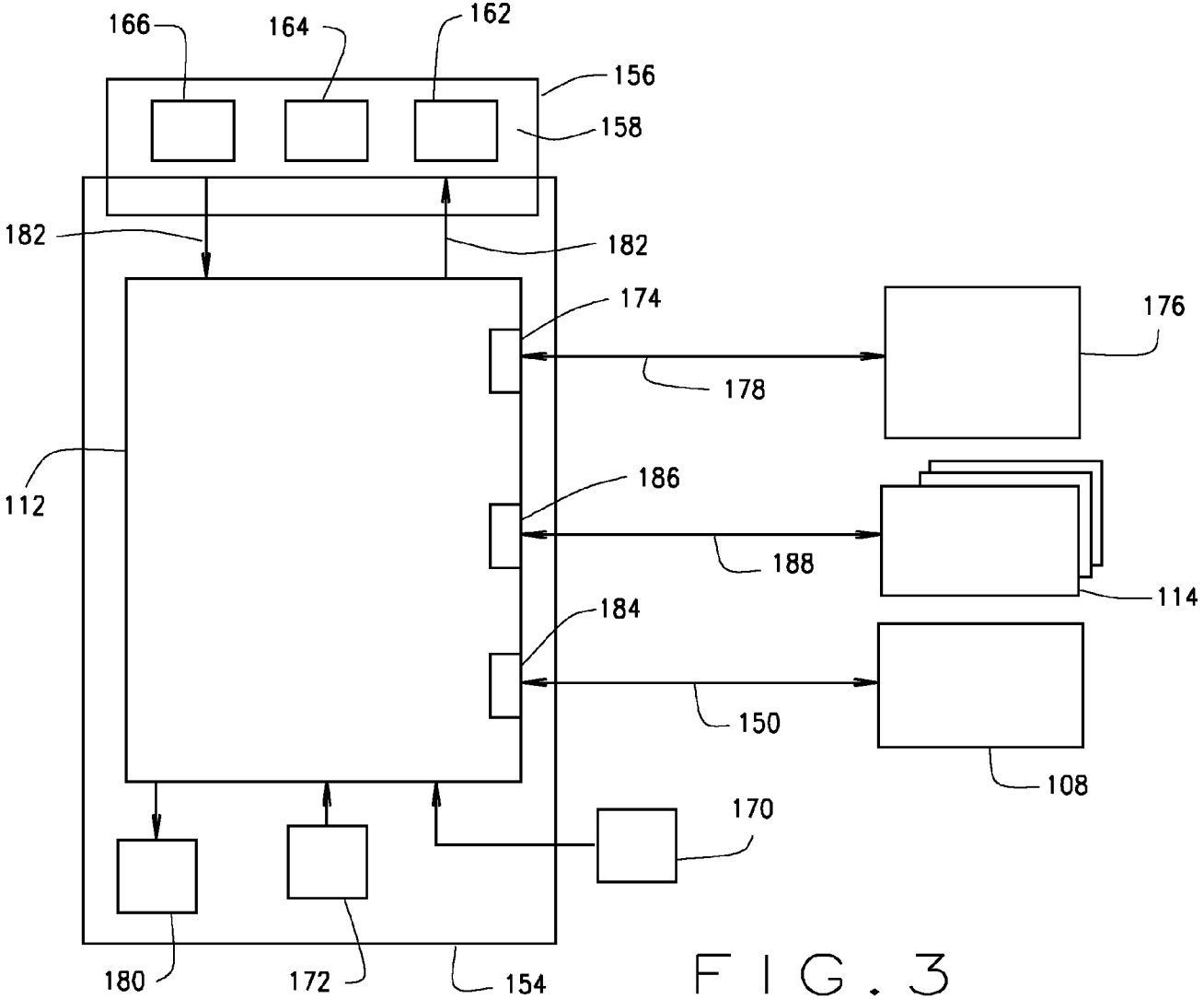
FIG. 3 is a block diagram of a primary control panel system and the interfaces to external devices and systems according to one exemplary embodiment.

FIG. 3 is an exemplary embodiment of a primary control panel system 112 with exemplary and the interfaces to external devices and operational systems as described herein. The primary control panel system can be assembled or housed in a body 154 as shown in FIG. 2 and include a power input 170 such as a AC or DC power source that can include a AC/DC converter or a battery by ways of example. As a computer implemented system, the primary control panel system 112 can include one or more manually configurable settings or inputs 172 such as dip switches or the like, or have a communication interface 172 for receiving programming or system configuration data or settings from a configuration computing device 176 via communication link 178. The primary control panel system 112 can provide a system status user interface 180 for providing a status of its operations, such as via LED lights or a display. As noted above, the primary control panel system 112 can include a local or remotely positioned display 158 that include display layout 160, status indicators 162, control input interface 164 with one or more user inputs 166. These are coupled to the primary control panel system 112 via internal or external communications links 182. Also as addressed above, the primary control panel system 112 is coupled to the interlocking controller 108 via communication link 150 via first communication interface 184. The primary control panel system 112 also includes a second communication interface 186 for communicating with the one or more associated remote control panel systems 114 via communications link 188. As should be evident to one of skill in the art from reading this disclosure, while the various communication interfaces 174, 184, and 186 and the various communication links 150, 178, 182 and 188 are shown as being separate and distinct in FIG. 3, this is only by way of example, one or more of the communication interfaces 174, 184 and 186, as well as others implemented by the primary control panel system 112 can be combined and the communication links 150, 178 and 182 may also be separate or common among the interfaces such as described below. Further, these may be implemented by any suitable communication technology including any suitable wired or wireless communication protocol, facility, network or system.

Figure 4:
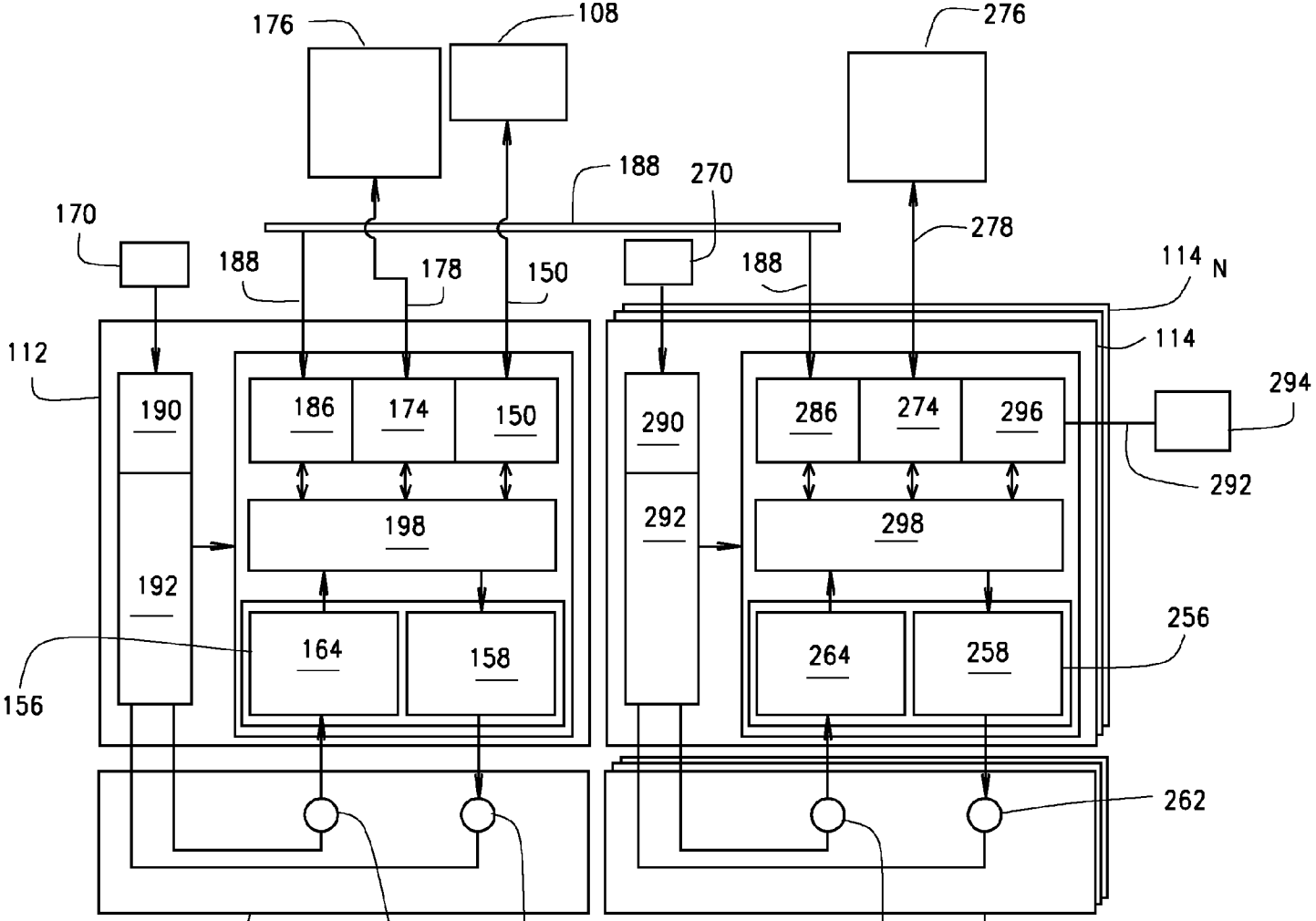
FIG. 4 is a block diagram of a primary control panel system and a plurality of remote control panel systems coupled via an Ethernet communication network.

FIG. 4 illustrated one exemplary embodiment of the primary control panel system 112 in relation to one or more remote control panel systems 114 (the first shown as 114 and the others shown as 114N. The primary control panel system 112 in this embodiment communicates via second communication interface 186 with the remote control panel systems 114 via a wired or wireless network 188, which may be an Ethernet or similar suitable communication network technology. The primary control panel system 112 is a computer implemented system having a processing system 198 as will be described in more detail below. In this example, the power source 170 provides power such as about 10-16 VDC by way of example, to an isolated battery input 190 that is coupled to an internal power source 192 that can include about 5 VDC and common primary control panel system power.

As shown, the remote control panel system 114 can include a remote panel user interface 256 with a remote display 258 with one or more control input interfaces 264, one or more remote user inputs 266 and one or more remote status indicators 262. The remote control panel system 114 is also a computer implemented system having a processing system 298 as will be described in more detail below. In this example, the remote control panel system 114 receives power from a power source 270 provides power such as about 10-16 VDC by way of example, to an isolated battery input 290 that is coupled to an internal power source 292 that can include about 5 VDC and common remote control panel system power. The remote control panel system 114 was a first interface 274 coupled via communication link 278 to a configuration PC for receiving programming instructions and executable code and setting data. It also has a communication interface 286 that is coupled to communication network 188 for communicating with the primary control panel system 112. The remote control panel system 114 can also include local communication interface 296 such as an isolated serial interface, USB, Wi-Fi, blue tooth, by ways of example, providing local communication over local communication link 292 with local communicating devices 294.

Figure 5:
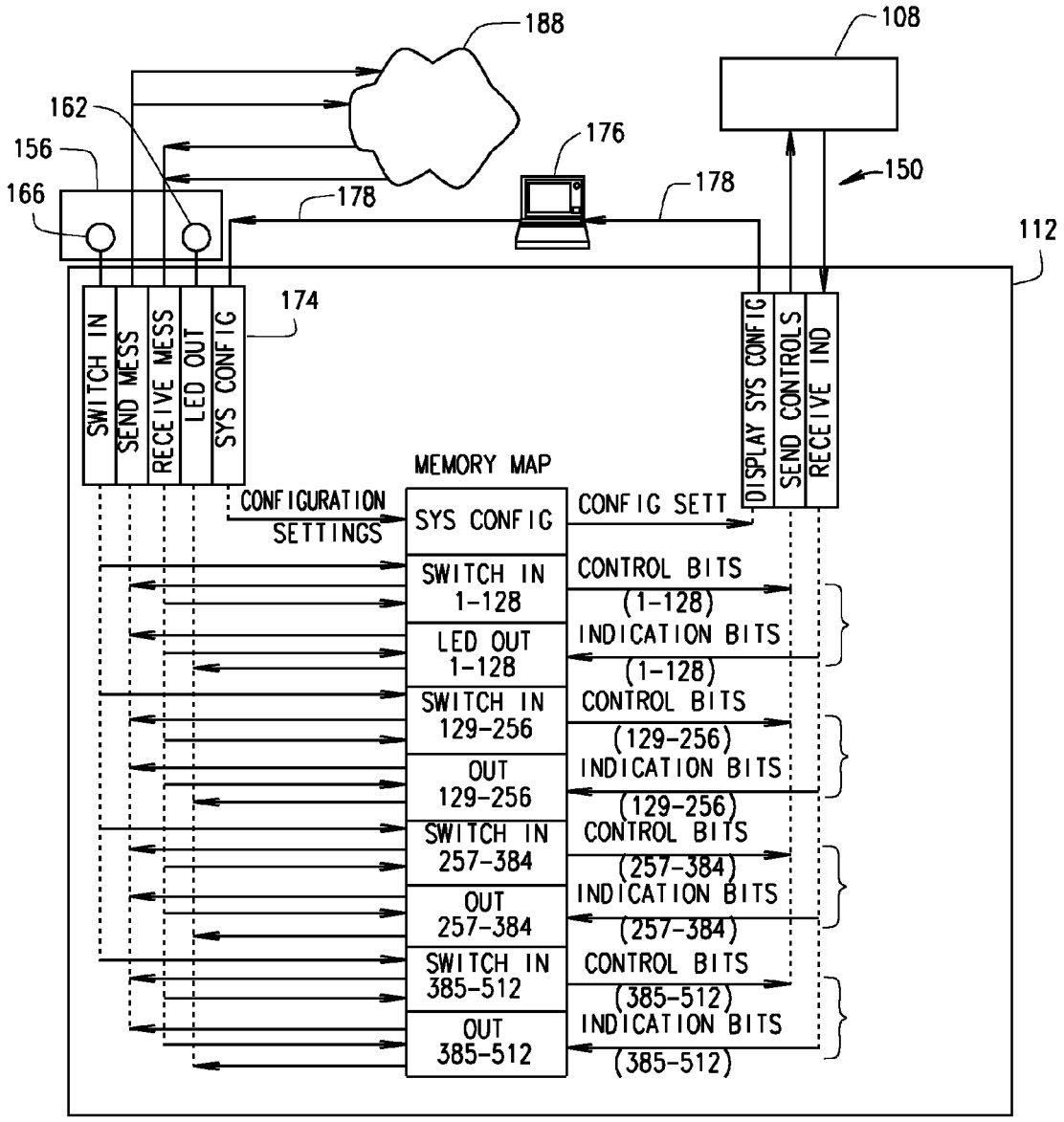
FIG. 5 is a block diagram with a memory mapping of inputs from the interlocking system to one or more remote control panel systems showing one process according to one exemplary embodiment.

FIG. 5 is a block diagram with a memory mapping of inputs from the interlocking system to one or more remote control panel systems showing one process according to one exemplary embodiment. This illustrates the flow of data bits for switches 120, status indicators 162, and user inputs 164 based on various configurations. The internal processing and memory map is shown as an example design and is likely to adapted as may be suitable, but is considered an example of one possible embodiment. As shown, remote control panel switch inputs, outputs and status indicator inputs and outputs are provided to the primary control panel system 112 and configuration settings are received via interface 174 from configuration system 178. This memory mapping of inputs to outputs with one or more remote control panel systems 114 and with an interlocking controller 108 provides for a mapping of status indicators and control inputs and requests so that the operation of the remotes control panels 114 are unknown to the interlocking controller 108. In this manner, the primary control panel system 112 acts as an aggregator and gateway between one or more remote control panel systems 114, and other remote control panel systems 114, the interlocking system 108 as well as other interlocking systems 108 and a central control 106.

As shown in FIG. 5, a single primary control panel system 112 can be configured to communicate with the interlocking system 108 using a predefined standard protocol such as the GETS LCP Protocol over an RS-232 interface. In this example, only the physical inputs from user inputs 166 and status indicators 162 would be available for controls and indications (128 I/O). In this configuration, a remote control panel system 114 is added by a simple connecting of the remote control panel system 112 to the primary control panel system 114 using the communication link 188 such as an Ethernet connection. The system would then be configured via the network with network settings (such as IP addresses, etc.) to uniquely identify itself from the other system. The duplicate panel system 114 would not be connected to an interlocking controller 108. When a user input 266 receives an input from a user at the remote control panel system 114, such as a pushbutton of switch closure, a message is sent over the network 188 to the primary control panel system 112 to update that same user input 166, which is then delivered as a control bit to the interlocking controller 108. Similarly, when an indicator status 162 changes state on the primary control panel system 112, the physical status indicator 262 is updated at the remote control panel system 114 via a communication message sent over network 188 to the remote or duplicated control panel system 114 so that the same status indicator 162 has the same indicator status represented thereon.

Figure 6:
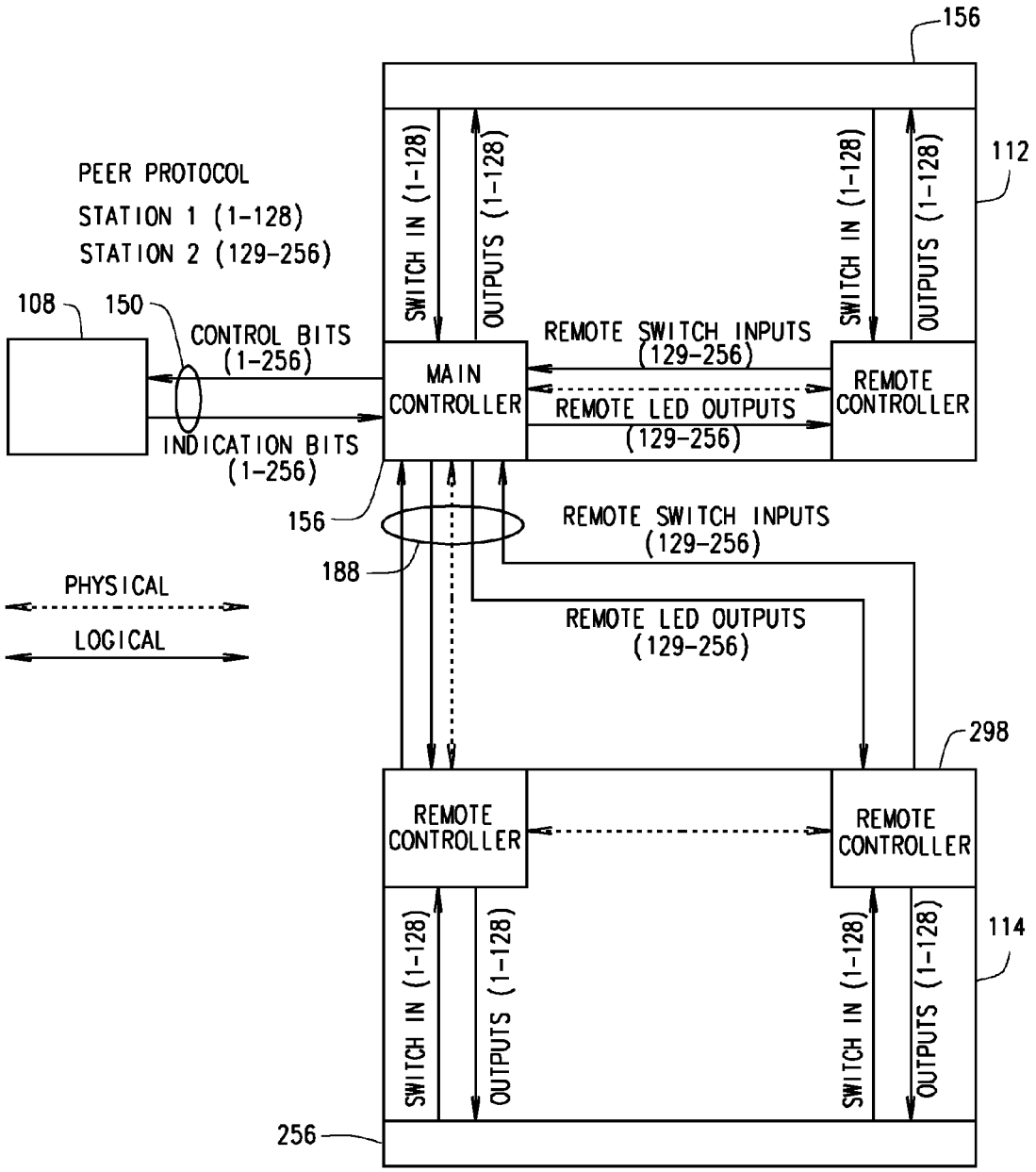
FIG. 6 is a schematic diagram of a primary control panel system coupled to an interlocking system and the interfacing with a single remote control panel system.

FIG. 6 is a schematic diagram of a primary control panel system 112 coupled to an interlocking system 108, and interfacing with a remote control panel system 114 system. This illustrates the physical and logical communications and links between the for "duplication" of the primary control panel system 112 using one or more remote control panel systems 114 as providing herein. This embodiment reflects adding a remote control panel system 114 using the above described architecture and system configuration that is as simple as duplicating the primary control panel system 112 or one or more remote control panel systems 114, connecting them together with an communication link 188 such as an Ethernet cable and configuring the network settings such as the IP addresses, etc. The remote control panel system 114 acts as a duplicate of the primary control panel system 112 in all functions as to status indicators with 262 being the same 162 and vice versa and user inputs being the same with 266 being the same as 166. The one or more remote control panel systems 114 are only coupled to the primary control panel system 112 that acts as an aggregator and gateway and is not visible or known to the interlocking system 108 as the remote control panel systems 114 are not connected to the interlocking controller 108, but only interfaced through the primary control panel system 112.

Exemplary Digital Processing Railroad Wayside Interlocking System

Figure 7:
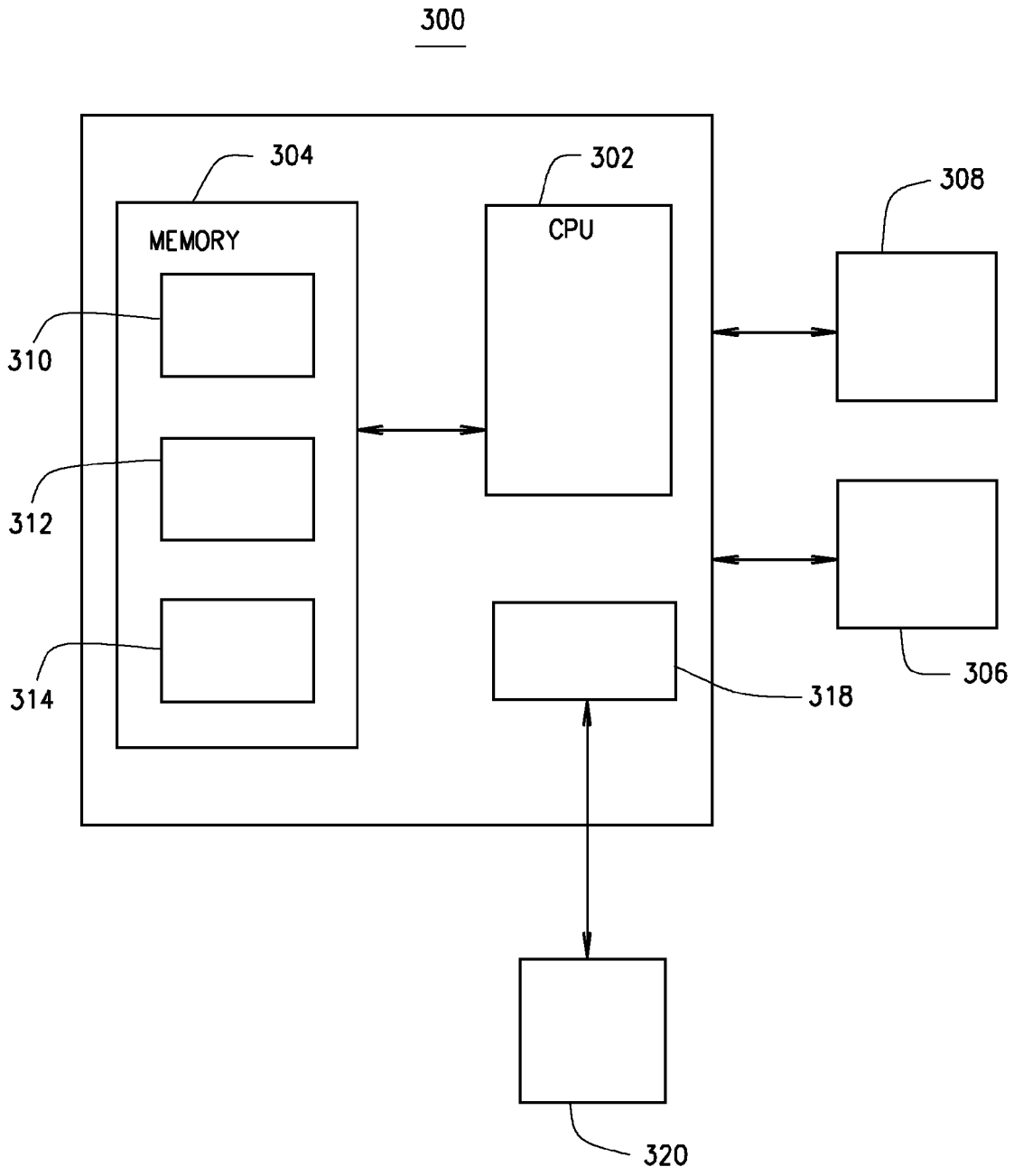
FIG. 7 illustrates an exemplary computer system environment according to one embodiment.

The systems, platforms, servers, applications, modules, programs, and methods described herein for the railroad wayside interlocking system 100 including the primary control panel systems 112 and/or remote control panel systems 114 and components thereof can include one or more a digital processing systems 198 and 298, respectively as described above and described herein simply as a digital processing system 300. Referring now to FIG. 7, there can be one or more hardware central processing units (CPU) 302 that carry out the functions as described above. The digital processing system 300 includes an operating system configured to perform executable instructions for the operation thereof. In most embodiments, the described digital processing systems 300 includes one or more memory devices 304, a display 306 (such as displays 158 and 258, one or more input devices 308 (such as input devices 164, 264, status indicators 162, 262 and in some embodiments can include a sound output device such as an alarm or status or verification signal. In some embodiments, the digital processing system 300 can be connected to one or more data networks 320 (such as communication networks 150, 178, 182, and 188) that can be a wired network, a mobile network, a wireless network such as a Wi-Fi or a Bluetooth™ network or a wired data network. These data networks 320 can be utilize to access the Internet or an intranet such as for accesses to the World Wide Web or other Internet based services. These can include, but are not limited to such data network accessible systems or applications such as a data storage device, a cloud service, an application server, a terminal or exchange server. In some embodiments, the digital processing system 300 is a non-portable device, such as a server or a desktop computer but in many embodiments it can be a portable device, such as a laptop, tablet computer, a mobile telephone device or a digital audio player.

The systems, platforms, servers, programs, and methods disclosed herein for one or more components or features of the railroad wayside interlocking system including the primary and/or remote control panels and components thereof and methods as described herein can include one or more computer programs each of which are composed of sequences of computer executable instructions for the digital processing system's CPU each of which are developed to perform one or more specified tasks. Those of skill in the art will recognize that the computer program may be written in various computer programming languages having one or more sequence of instructions. The computer program can be loaded to the CPU 302 or associated memory 304 via a data network connection 320 or a local memory device, but are increasingly via a data network download. Typically, a computer program such as the operating system 310 is loaded by local memory device 304 such as CD or DVD. In some embodiments, the computer program is delivered from one location to one or more locations and can be increasingly distributed via a cloud computing or application service. In various embodiments, the computer program comprises, in part or in whole, one or more web, web browser, mobile, standalone or applications, extensions, add-ins, or add-ons, or combinations thereof. The systems, platforms, servers, programs, and methods disclosed herein above and throughout include, in various embodiments, software, server, and database modules. The software modules are created by techniques known to those of skill in the art using machines, software, and languages known to the art, some of which are disclosed above.

As noted, a digital processing system 300 typically includes one or more memory or data storage devices 304. The memory 304 stores data including the operating system 310 and application programs 312 as well as operating data 314 on a temporary or permanent basis. In some embodiments, the memory 304 can be volatile and requires power to maintain stored information but can also be non-volatile and retains stored information when the digital processing system 300 is not powered. Further, the memory 304 can be located with the digital processing systems 300 or can be attachable thereto either physically or via a data network connection to a remote memory 304. In some embodiments, the memory 304 can include CD-ROMs, DVDs, flash memory devices, solid state memory, magnetic disk drives, magnetic tape drives, optical disk drives, cloud computing systems and services, and the like.

As noted, the digital processing system 300 includes an operating system 310 configured to perform executable instructions which is stored in memory 304. The operating system can include software, including programs and data, which manages the device's hardware and provides services for execution of software applications/modules. Those of skill in the art will recognize that suitable operating systems can include, by way of non-limiting examples, Apple OS®, Microsoft® Windows®, Microsoft®, Windows®, Apple® Mac OS X®, UNIX®, and UNIX-like operating systems such as GNU/Linux®. In some embodiments, the operating system can be provided by cloud computing. Those of skill in the art will also recognize that embodiments of the remote control panel and some components of the primary control panel system may also be implemented using suitable mobile smart phones that include mobile operating systems including, by way of non-limiting examples, Nokia® Symbian®, OS, Apple® iOS®, Research In Motion® BlackBerry OS®, Google® Android®, Microsoft® Windows Phone®, OS, Microsoft® Windows Mobile®, OS, Linux®, and Palm® WebOS®.

The digital processing system 300 can include a visual display 306. In some embodiments, the display 306 can be a display faceplate board having a layout 160 or can be a computer controlled cathode ray tube (CRT) or an optical projector, but is increasingly a flat screen such as a liquid crystal display (LCD), a plasma display, a thin film transistor liquid crystal display (TFT-LCD), a light emitting diode (LED) or an organic light emitting diode. In other embodiments, the display 306 can also be a combination of devices such as those disclosed herein. Typically they are located proximate to the digital processing 300 but in some embodiments, the display can be remotely located such as a billboard using LED or electrowetting technology.

The digital processing system 300 can also include one or more an input devices 166 that comprise the control input interface 164, herein referred to generally as input devices 308. In some embodiments, the input device 308 can be a push button, a key switch, a switch, a keyboard or keypad but these can also include a pointing device such as, by way of non-limiting examples, a mouse, touchpad, light pen, pointing stick, trackball, track pad, joystick, game controller, stylus, touch screen, multi-touch screen, a microphone that captures voice or other sound inputs or an optical image capture device that can capture images or motion or other visual input. In still further embodiments, the input device 308 can be a combination of devices such as those disclosed herein.

In some embodiments, the digital processing system 300 optionally includes one or more sound output devices (not shown but known to those of skill in the art). These sound output devices can be a set of speakers, a pair of headphones, earphones, or ear buds. The speakers can be of any technology including a flat panel loudspeaker, a ribbon magnetic loudspeaker, an electro-acoustic transducer or loudspeaker or a bending wave loudspeaker, or a piezoelectric speaker. In still further embodiments, the sound output device can be a combination of devices such as those disclosed herein.

Such systems utilize one or more communications networks 320 (such as those shown 150, 178, 182, 188) can include wireline communications capability, wireless communications capability, or a combination of both, at any frequencies, using any type of standard, protocol or technology. In addition, in the present invention, communications network 320 can be a private network (for example, a VPN) or a public network (for example, the Internet). A non-inclusive list of exemplary wireless protocols and technologies used by communications network 320 includes BlueTooth™, general packet radio service (GPRS), cellular digital packet data (CDPD), mobile solutions platform (MSP), multimedia messaging (MMS), wireless application protocol (WAP), code division multiple access (CDMA), short message service (SMS), wireless markup language (WML), handheld device markup language (HDML), binary runtime environment for wireless (BREW), radio access network (RAN), and packet switched core networks (PS-CN). An exemplary non-inclusive list of primarily wireline protocols and technologies used by communications network 320 includes asynchronous transfer mode (ATM), enhanced interior gateway routing protocol (EIGRP), frame relay (FR), high-level data link control (HDLC), Internet control message protocol (ICMP), interior gateway routing protocol (IGRP), internetwork packet exchange (IPX), ISDN, point-to-point protocol (PPP), transmission control protocol/internet protocol (TCP/IP), routing information protocol (RIP) and user datagram protocol (UDP). As skilled persons will recognize, any other known or anticipated wireless or wireline protocols and technologies can be used.

In accordance with the description provided herein, a suitable digital processing system 300 can include, by way of example, server computers, desktop computers, laptop computers, notebook computers, tablet computers, mobile phones such as smart phones, audio devices, personal digital assistants, netbook computers, smartbook computers, subnotebook computers, ultra-mobile PCs, handheld computers, Internet appliances, and video game systems both portable and fixed.

Client-Server Environment Embodiment

Figure 8:
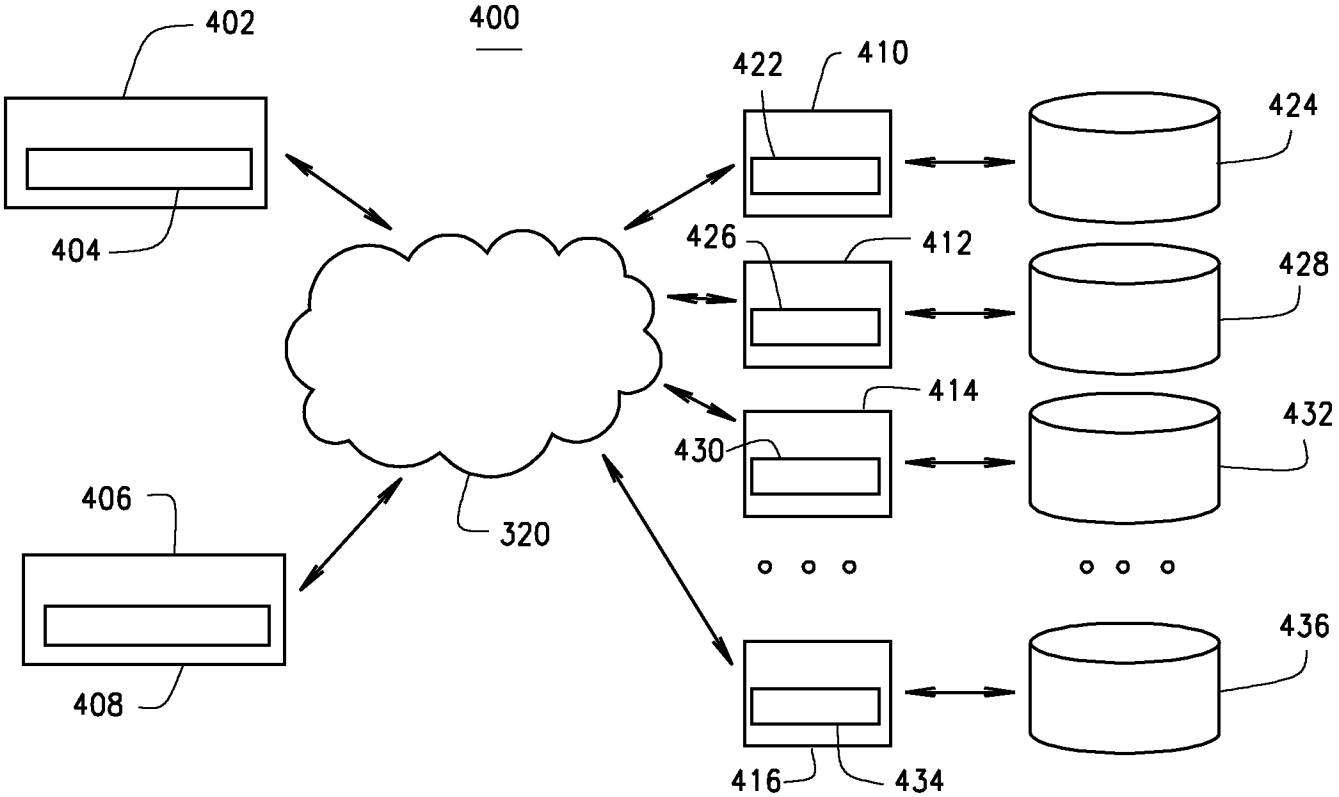
FIG. 8 illustrates an exemplary client-server environment according to yet another embodiment.

FIG. 8 illustrates a detailed exemplary client-server environment 400. Environment 400 of FIG. 8 includes the aforementioned communications network 320, a plurality of clients 402, 406 and a plurality of servers 410, 412, 414, 416 connected to network 320. The servers 410, 412, 414, 416 are shown connected to a plurality of database servers (DSs). Specifically, server 410 is connected to DS 424, server 412 is connected to DS 428, server 414 is connected to DS 432, and server 416 is connected to DS 436. As one example, the primary control panel system 112 can be implemented as a server 414 and one or more of the remote control panel systems 114 can be implemented as a client, 402, 406.

The clients 402, 406 and the servers 410-416 are nodes connected to network 520, defined by their respective information retrieval functions. Client 402 includes a client application 404, which is an information requesting or receiving application associated with client 402, and client 406 includes a client application 408, which is an information requesting or receiving application associated with client 406. Client applications 404, 408 can run either on clients 402, 406, respectively, or can run on another node and are then passed to the clients 402, 406. In one or more embodiments, the client applications 404, 408 are web browsers.

Servers 410-416 include a variety of processes, including operating systems, web server applications and application servers. The operating systems, which can also be called platforms, are the software programs that applications use to communicate with the physical parts of the servers 410-416. Examples of operating systems that can be used with the present invention include: Linux™, Sun Solaris™, Windows NT/2000™, Cobalt RaQ™, and Free BSD™, although any operating systems known or anticipated can be used.

The web server applications are software running on servers 410-416 that make it possible for the client browsers 404, 408 to download stored web pages. These applications also coordinate streaming audio, video, and secure e-commerce, and can be integrated with databases (as described below) for information retrieval. Examples of web server applications that can be used with the present invention include: Apache™, Microsoft's Internet Information Server (IIS)™, O'Reilly & Associates WebSite Pro™, Netscape's FastTrack Server™, and StarNine's WebSTAR™ (for Macintosh), although any operating systems known or anticipated can be used.

The application servers sit on top of the formatting and display languages (for example, HTML) that a request from clients 402, 406 generate and translated the request for databases. Upon receiving information from databases, the application servers will translate this information back to the formatting and display languages and sent a response back to the browser. In one or more embodiments, the application server software resides at the servers 410-416, although with cross-platform programming technology, software performing the same functions can reside at clients 402, 406 as well. In one or more embodiments, the application servers will insert strings of programming code into the formatting and display language, with client browsers 404, 408 employing interpreters (or a plug-ins) to translate back into the formatting and display language (for example, HTML) to display a page. Examples of application servers that can be used with the present invention include: Cactus™, Cold Fusion™, Cyberprise Server™, Ejipt™, Enterprise Application Server™, Netscape Application Server™, Oracle Application Server™, PowerTier for C++™, PowerTier for Enterprise Java Beans™, Secant Extreme™, Enterprise Server™, SilverStream™, WebEnterprise™, WebSpeed™, and WebSphere™ although any application servers known or anticipated can be used.

Taken together, the web servers and applications servers perform at least these functions: (i) providing an environment upon which server components can run; (ii) functioning as is a main program under which other components run as subroutines; (iii) providing services (for example, security related services, transaction related services), state management, and resources (for example, database connections); (iv) enabling communication with clients 402, 406.

For the convenience of condensing terminology, the aforementioned applications working, which work together on the servers 410-416 (or instead are processed at other nodes and passed to servers 410-416) are referred to as "application servers." FIG. 8 illustrates applications servers (ASs) 422, 426, 430, 434 respectively can run on clients 410, 412, 414, 416. In operation, client browsers 404, 408 are used to issue requests for information, or queued to transmit information, over network 520. Requests and responses are handled by servers 410-416 via running of ASs 422, 426, 430, 434, which in turn transmit information over network 520 for display by browsers 404, 408.

In one or more embodiments, additional functions required of ASs 422, 426, 430, 434 will be to connect the web servers 410-416 to, for example, back-end data resources such as relational tables, flat files, e-mail messages, and directory servers. In exemplary embodiments, additional programs incorporated in ASs 422, 426, 430, 434 typically called "middleware," database utilities, or database management systems (DMBS) can be used, among other known or anticipated database methods.

For example, the ASs 422, 426, 430, 434 can include their own internal DBMSs, or DBMSs of other nodes, or the DBMSs labeled database servers (DSs) 424, 428, 432, 436. The DBMS refers to computer software for storing, maintaining, and searching for data in a database. In the present invention, the DBMS can also utilize facilities for increasing reliability and performance, and integrity, such as indexes, logging, and record locking.

In one or more embodiments, the DBMS includes interfaces for searching for and locating particular data items from the database and for presenting the result of these queries to a search engine. A search engine as used herein searches the database in response to a user request, which can be initiated at client browser 402, 406, for example, or at server 422-424, for example, and returns a result to the user, for example in the form of a relational table viewable in browsers 404, 408. The DBMS can refer to any type of database, including a relational DBMS (RDBMS), LDAP™, VSAM™, IMS™, Active Directory Services™, message stores, to name a few.

In one or more embodiments, the DBMS is an RDBMS that uses relational database to retrieve information from the railroad wayside interlocking system inventory and/or status or parameter or administrative databases. In one or more embodiments, the relational database uses structured query language (SQL™), including SQL defined according to International Standards Organization (ISO) and American National Standards Institute (ANSI) standards, or follow these standards with additional language constructs. In one or more exemplary embodiments, ASs 422-424 are respectively connected to DSs 424-436 via an application programming interface (API), including for example the open database connectivity (ODBC™), Java database connectivity (JDBC™), APIs.

Any types of DBMS platforms can be used in the various systems and components of the railroad wayside interlocking system and methods. Exemplary platforms that can be employed include Sun Microsystems' Java™, 2 Platform, Enterprise Edition (J2EE)™ that contains an Enterprise Java- Beans™. (EJB) server-side component architecture, and Microsoft's Windows™, Distributed interNet Applications Architecture (Windows DNA™), which contains the COM+™ server-side component architecture.

As described above, the system and method above provides an expansion to a wayside interlocking system for additional locations and user points of contact without modifying or expanding the interlocking system itself or otherwise complicating the design of the interlocking system. The described system and method herein provides a railway operator to expand the monitoring displays and user operability of one or more interlocking systems at lower cost, lower complexity and without customization by the supplier of the interlocking system thereby providing the railway operator considerable expanded and enhanced maintenance and logistics operations of a rail yard or a rail operations.

When describing elements or features and/or embodiments thereof, the articles "a", "an", "the", and "said" are intended to mean that there are one or more of the elements or features. The terms "comprising", "including", and "having" are intended to be inclusive and mean that there may be additional elements or features beyond those specifically described.

Those skilled in the art will recognize that various changes can be made to the exemplary embodiments and implementations described above without departing from the scope of the disclosure. Accordingly, all matter contained in the above description or shown in the accompanying drawings should be interpreted as illustrative and not in a limiting sense.

It is further to be understood that the processes or steps described herein are not to be construed as necessarily requiring their performance in the particular order discussed or illustrated. It is also to be understood that additional or alternative processes or steps may be employed.

What is claimed is:

1. A system for expanded monitoring and control of a railroad wayside interlocking system that monitors a plurality of track side and train systems and controls a plurality of train and track control devices, the system comprising:

a primary control panel system having a memory, a processor, a user interface including a display and a user input device, computer executed instructions stored in the memory and accessible and operable by the processor, a first communication interface and a second communication interface, the first communication interface coupling to the interlocking system and receiving a plurality of interlocking status messages and for communicating requests as received by the primary control panel system to the interlocking system, the display being responsive to the received interlocking status messages for visually displaying a current status state of the monitored systems, the primary control panel system manages a replication of the received interlocking status messages and communicates the received interlocking status messages or a determined current status state based on the received interlocking status messages over the second communication interface; and a remote control panel system having a memory, a processor, a user interface including a display and a user input device, computer executed instructions stored in the memory and accessible and operable by the processor, and a communication interface communicating with the second communication interface of the primary control panel system and receiving the replicated interlocking status messages or the determined current status state, the display of the remote control panel system displaying the current status state of the monitored systems, the user input device of the remote control panel system for receiving an input request from a user for a change in state of one of the control devices, the remote control panel system transmitting a remote request for the change of state of the control device over the communication interface to the second communication interface of the primary control panel system responsive to the receiving of the input request from the user, wherein the primary control panel system receives the request for the change of state of the control device and transmits an interlocking change of control request over the first communication interface to the interlocking system.

2. The system of claim 1 wherein the primary control panel system receives the remote request for the change of state of the control device from the remote control panel and transmits the interlocking change of control request over the first communication interface to the interlocking system responsive to the received remote request from the remote.

3. The system of claim 1 wherein the user interface control of the primary control panel system receives an input request from the user for a change in the state of one of the control devices and wherein the primary control panel system transmits the interlocking change of control request over the first communication interface to the interlocking system responsive to the received remote request from the remote.

4. The system of claim 1 wherein there are a plurality of remote control panel systems as recited by claim 1 each with a communication interface communicatively coupled to the second communication interface of the primary control panel system, wherein the primary control panel system communicates the received interlocking status messages or their determined current status state to each of the plurality of remote control panel systems.

5. The system of claim 4 wherein the primary control panel system communicates to and from the remote control panel systems transparently to the communication with the interlocking system.

6. The system of claim 4 wherein the primary control panel system uniquely identifies and manages each of the coupled remote control panel systems including uniquely identifying the request for a change of state of a control device from each remote control panel system and wherein the primary control panel system transmits to the interlocking system over the first communication interface the unique identification of the remote control panel system from which the request for change of state was received.

7. The system of claim 4 wherein the primary control panel system transmits the request for change of state as received from one of the remote control panel systems to the other coupled local control panel systems as a pending request indication associated with the primary control panel system and the coupled remote control panel systems.

8. The system of claim 1 wherein the primary control panel system manages the replication of the received interlocking status messages by mapping the received status message to an associated status message state of the remote control panel system.

9. The system of claim 1 wherein the primary control panel system maps the received request for a change of state to a request of a change of state to the interlocking system.

10. The system of claim 1 wherein the remote control panel system includes an illustrated display that is a computer display screen or a display faceplate board of all or a portion of the track side systems including a layout of the railroad track and all or a portion of the monitored track side and train systems and the controlled train and track control devices that is a duplication of only a portion of the illustrated display of the primary control panel system.

11. The system of claim 1 wherein the display of the primary control panel system is a computer display screen or a display faceplate board illustrating all or a portion of the track side systems including a layout of the railroad track and all or a portion of the monitored track side and train systems and the controlled train and track control devices.

12. The system of claim 11 wherein the remote control panel system includes a remote computer display screen or a remote display faceplate board that illustrates a duplication of the illustrated display of the primary control panel system.

13. The system of claim 11 wherein the display of the remote control panel system is via a predefined permanent illustration on a faceplate associated with all or a portion of the illustrated track side systems as displayed by the primary control panel.

14. The system of claim 1 wherein the second communication interface of the primary control panel system is a wireless interface or a wired interface, and wherein the communication interface of the remote control panel system is a communicatively compatible communication interface thereto.

15. The system of claim 1 wherein the remote control panel system is a computer system customized by the computer executable instructions and wherein the user input device is an input device of the computer system and wherein the computer system of the remote control panel system is selected from the group consisting of a laptop computer, a localized self-contained computer, a mobile telephone, and a tablet computer.

16. The system of claim 1 wherein the first communication interface is coupled to a first communication network and the second communication interface is a separate interface communicating over a separate second communication network and wherein the first communication interface communicates using a serial communications protocol and wherein the second communication interface communicates using a different communications protocol.

17. A method for expanded monitoring and control of a railroad wayside interlocking system monitoring a plurality of track side and train systems and controlling a plurality of train and track control devices, comprising:

a) in a primary control panel system having a memory, a processor, a user interface including a display and a user input device, computer executed instructions stored in the memory and accessible and operable by the processor, a first communication interface and a second communication interface:

receiving a plurality of interlocking status messages from the communicatively coupled interlocking system over the first communication interface;

displaying a determined current status of one of the monitored systems on the display of the primary control panel system responsive to the received interlocking status messages;

replicating of the received interlocking status messages;

communicating the replicated interlocking status messages or a determined current status state based thereon over the second communication interface;

receiving a request for a change of state of one or more of the control devices;

transmitting an interlocking change of control request over the first communication interface to the interlocking system responsive to the received request for the change of state of the one or more control devices; and b) in a remote control panel system having a memory, a processor, a user interface including a display and a user input device, computer executed instructions stored in the memory and accessible and operable by the processor, and a communication interface for communicating with the second communication interface of the primary control panel system:

receiving the communicated replicated interlocking status messages or the determined current status state; and displaying on the display of the remote control panel system the current status state of the monitored systems responsive to the received replicated interlocking status messages;

receiving an input request from a user for a change in the state of the one or more control devices.

18. The method of claim 17, further comprising:

at the remote control panel system, transmitting over the communication interface to the primary control panel system a remote request for the change of state of the one or more control devices is the received request responsive to the received user input, wherein receiving at the primary control panel system the request for the change of state of the one or more control devices is the received request for the change of state over the second communication interface from the remote control panel system and wherein transmitting the interlocking change of control request is responsive to the request received from the remote control panel system.

19. The method of claim 17, further comprising:

at the primary control panel system, receiving an input request from a user of the primary control panel user input device for changing a state of one of the control devices, wherein receiving at the primary control panel system the request for the change of state of the control device is the received request for the change of state from the user input request of the user of the primary control panel user input device and wherein transmitting the interlocking change of control request is responsive to the request received therefrom.

20. The method of claim 18 wherein there are a plurality of remote control panel systems coupled to the same primary control panel system over the second communication interface, each of remote control panel systems performing the steps as recited by claim 18.

21. The method of claim 20 wherein the displaying by each of the remote control panel systems is a duplication of the displaying at the primary control panel system.

22. The method of claim 20 wherein at the primary control panel system, uniquely identifying each of the coupled remote control panel systems and uniquely identifying each request for a change of state of a control device as being associated with the uniquely identified remote control panel system from which the request was received.

23. The method of claim 20 wherein at primary control panel system transmitting to the interlocking system the unique identification of the remote control panel system from which the request for change of state was received.

24. The method of claim 17 wherein at the primary control panel system the communicating with the remote control panel systems is transparent to the communicating with the interlocking system.

25. The method of claim 17 wherein at the primary control system the replicating is mapping the received status message to an associated status message state of the remote control panel system.

26. The method of claim 17 wherein at the primary control system, further comprising mapping the received request for a change of state to a request of a change of state to the interlocking system.

27. The method of claim 17 wherein the displaying at the primary control system includes illustrating all or a portion of the track side systems including a layout of the railroad track and all or a portion of the monitored track side and train systems and the controlled train and track control devices.

* * * * *